US006061872A

United States Patent [19]

Albrecht et al.

[11] Patent Number: 6,061,872

[45] Date of Patent: May 16, 2000

[54] CABINET HINGE

[75] Inventors: Markus Albrecht, Lustenau, Austria; Georg Domenig, Kernersville, N.C.; Johannes Hammerle, Hochst, Austria; Reinhard Karl, Schwerzach, Austria; Wolfgang Muller, Lustenau, Austria

[73] Assignee: Grass GmbH, Austria

[21] Appl. No.: 09/032,868

[22] Filed: Mar. 2, 1998

[51] Int. Cl.[7] ..... E05D 7/10

[52] U.S. Cl. ..... 16/258; 16/257

[58] Field of Search ..... 16/258, 257, 236, 16/237, 249, 251, 238

[56] References Cited

U.S. PATENT DOCUMENTS

| | | | |
|---|---|---|---|
| 4,799,290 | 1/1989 | Lautenschlager, Jr. | 16/258 |
| 4,976,006 | 12/1990 | Lautenschlager | 16/257 |
| 5,056,189 | 10/1991 | Brustle et al. | 16/258 |
| 5,062,180 | 11/1991 | Lautenschlager, Jr. | 16/257 |
| 5,105,506 | 4/1992 | Lin | 16/258 |
| 5,245,727 | 9/1993 | Sasaki | 16/258 |
| 5,253,390 | 10/1993 | Gross et al. | 16/257 |

FOREIGN PATENT DOCUMENTS

| | | | |
|---|---|---|---|
| 3444487A1 | 6/1987 | Germany | 16/258 |
| 176085 | 7/1990 | Japan | 16/258 |

*Primary Examiner*—Chuck Y. Mah
*Attorney, Agent, or Firm*—Kilpatrick Stockton LLP

[57] ABSTRACT

The invention is a cabinet hinge that has a hinge arm or hinge fastened on a hinge cup; the hinge arm, that can be adjusted by means of an adjusting plate, can be connected to a fastening baseplate on the cabinet/furniture, and has a catch connection provided in order to make this connection.

According to the invention the adjusting plate is a one piece, partially resilient snap-on component that on one side has hook-shaped shanks that link with the baseplate and on the other side has shanks that engage into corresponding catch nose projections of the baseplate when pressure is placed on the adjusting plate by a suitable means forces sliding motion of the adjusting plate relative to the baseplate. Then the resilient component of the adjusting plate is secured against further shifting.

10 Claims, 6 Drawing Sheets

CABINET HINGE

Figure 1:
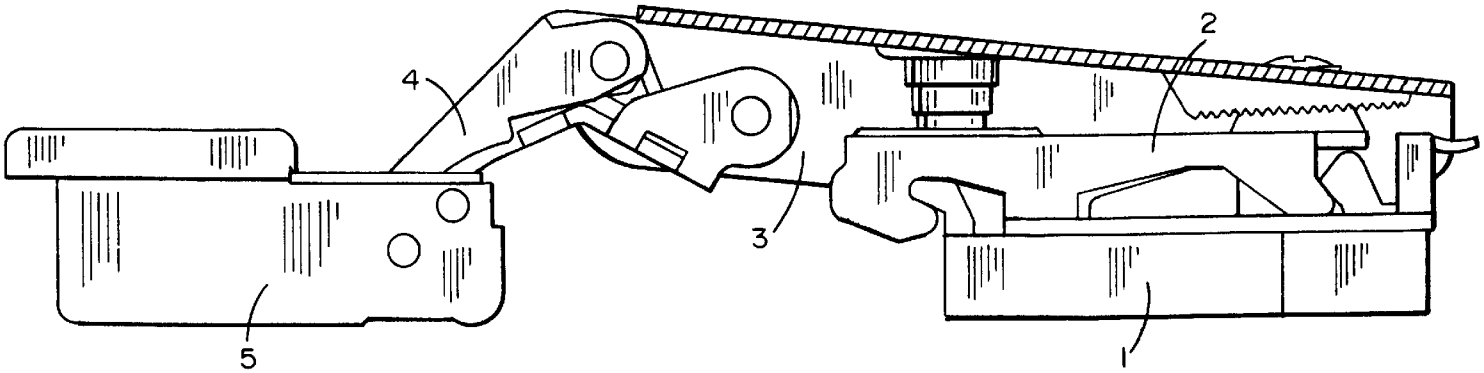

The invention pertains to a cabinet hinge according to the general concept of claim 1.

A cabinet hinge was made known by DE 37 11 064 C2, which describes a cabinet hinge that has an adjusting plate, whose slides are guided on a baseplate. A leaf spring is fastened under the adjusting plate. The hinge arm with an adjustable connected adjusting plate, as well as the leaf spring, are slid on the baseplate until the leaf spring reaches a corresponding stop and, thus, engages the adjusting plate on the baseplate. The disadvantage is that the hinges on the door (there are at least two hinges) must be pushed and engaged into the guides of the baseplate simultaneously. This can be certain conditions a tiresome process. Furthermore, the adjusting plate and the spring plate are separate components, which result in higher production costs.

The disclosure publication DF-GM 91 09 861 reveals a cabinet/furniture connector, particularly a hinge arm, that has a fastener component which must first be connected to the cabinet with plug-in openings and a second fastener component on the hinge arm with plug-in shanks that point forward. There is also a separate spring element, which is fastened on the hinge side? that engages when the shank is pushed into the plug-in openings on the cabinet side. A disadvantage of this cabinet/furniture connector is the long distance it must be pushed until it engages. The plug-in shanks project way out so that it becomes difficult to find the corresponding plug-in openings during assembly.

The object of the present invention is based on the task of further developing and improving a cabinet hinge of the aforementioned type that is easy and simple to assemble and install. Another task is to cut down on the individual parts needed, which minimizes production costs.

The present task is solved by the identifying characteristics of Patent claim 1.

The invention is based oil the catch process between the adjusting plate and baseplate that releases with pressure on the baseplate; whereby, it is preferred that the adjusting plate is designed as a partly resilient component or has a separate spring pawl and has a corresponding catch shank which through pressure on the adjusting plate by some suitable means, forces sliding motion of the adjusting plate relative to the baseplate, that engages in the corresponding catch nose projection of the baseplate, so that the resilient part of the adjusting plate secures the connection against further shifting.

Other advantageous embodiments and modifications of the invention are objects of the claims below.

The necessary shifting movement of the adjusting plate for the catch is achieved with the aid of the slanted gliding surfaces that glide along the adjusting plate with exerted pressure so that the adjusting plate's catch shank engages with the catch nose projection of the baseplate. It is of minor importance where these slanted gliding surfaces are located be it on the adjusting plate and/or the baseplate, on the catch shanks and/or the catch nose projections or other suitable surfaces of the adjusting plate or the baseplate.

What is important is that the adjusting plate has a resilient component that on the one hand delivers the necessary counter force of the adjusting plate's shifting motion, and on the other hand, activates the catch securing the connection against further shifting. The spring can either be a pivotal or swinging separate component on the adjusting plate, such as a sort of spring pawl or it can be designed as one piece with the adjusting plate.

This invention prevents the disadvantage of a long "plug-in" distance and the difficult positioning that was previously required to connect the hinge components and allows the hinge components to be assembled together without these problems and guarantees a precise and snug connection of the components with this snap-on system. The connection and automatic catch of the adjusting plate to the baseplate is achieved with a simple press of the finger. A short effortless pull of the finger on the resilient element releases the catch connection quickly and easily.

The invention related objectives of the submitted present invention results not only from the matter of the particulars in the patent claims, but also the various combinations of the individual patent claims. All records, documents and evidence, inclusive of the abstract, open and disclosed statements and declarations and indications and features, especially those represented embodiments in the drawings, will be claimed as fundamental and significant to the invention as far as the claims individually or in combinations are relative to the position that the technology is new.

The invention at hand will be explained more precisely by the various embodiments shown by the representational drawings. Hereby, additional significant features and advantages of the invention will be concluded from the drawings and their descriptions.

Figure 2:
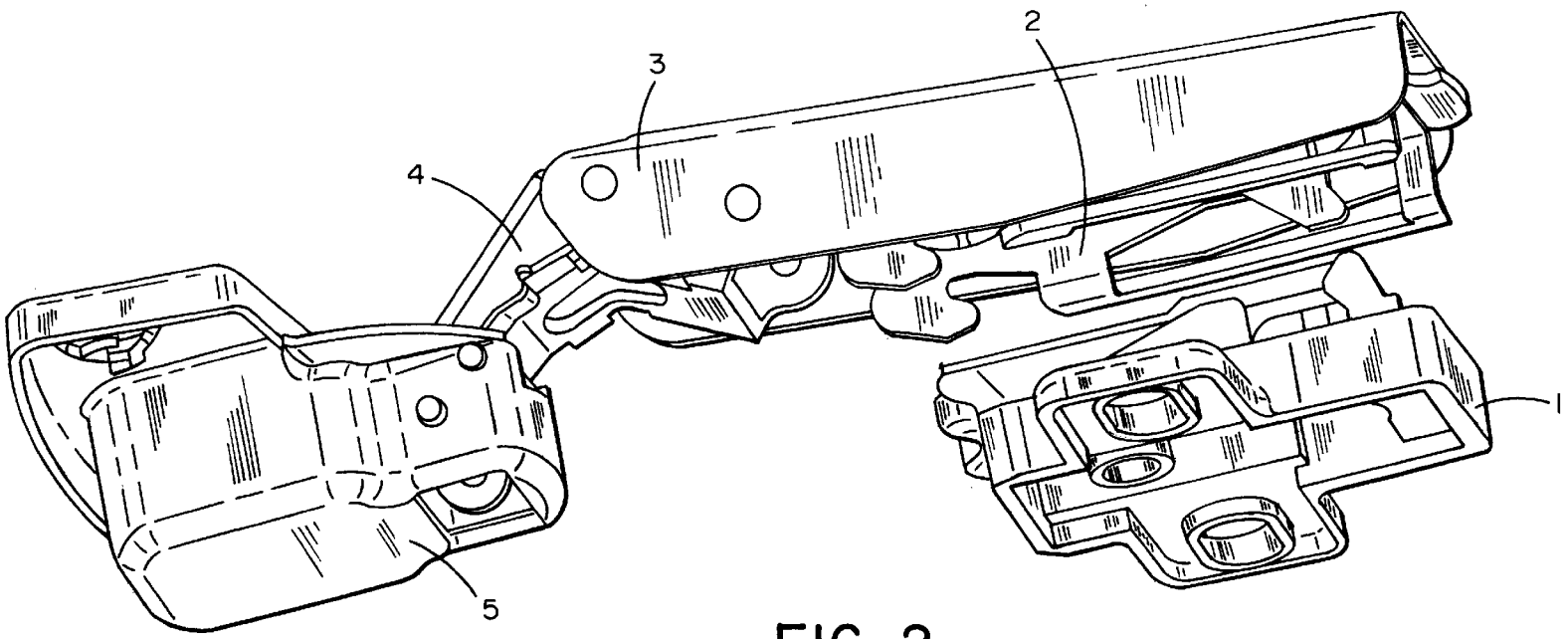
Figure 5:
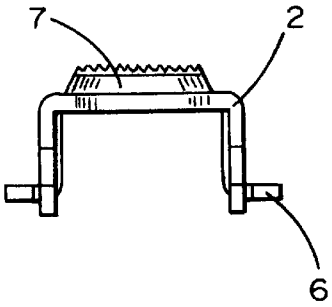
Figure 6:
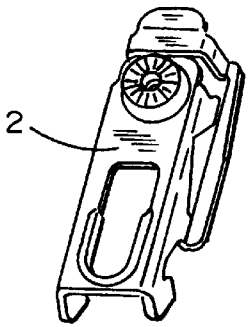
Figure 3:
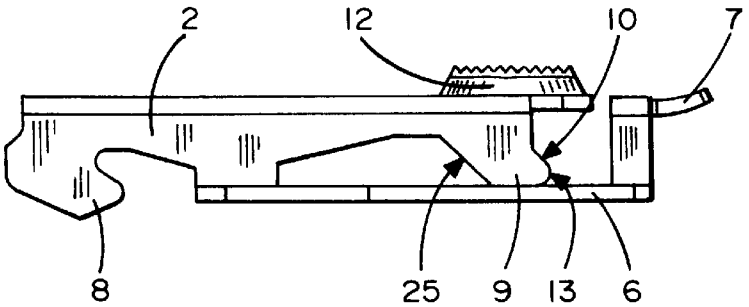
Figure 4:
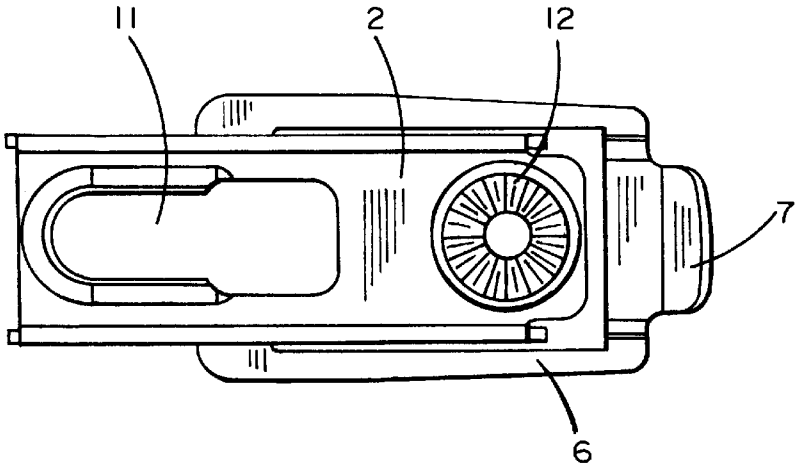
Figure 9:
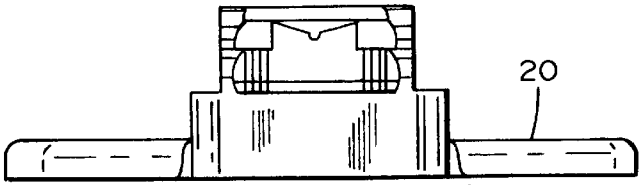
Figure 10:
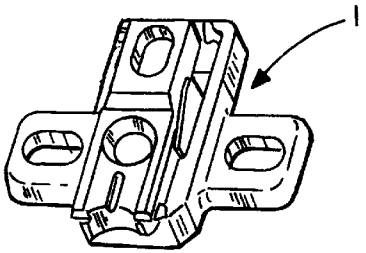
Figure 7:
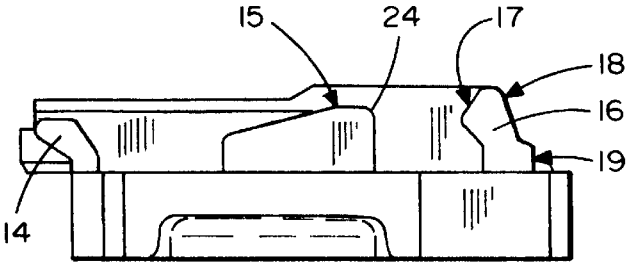
Figure 8:
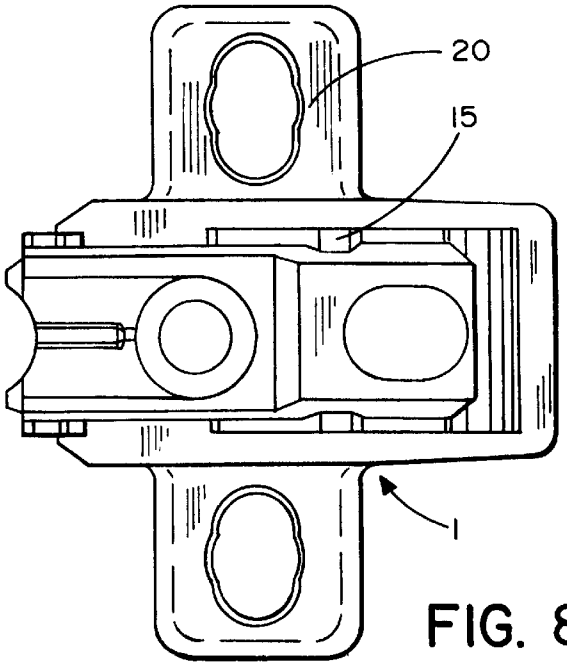
Figure 11:
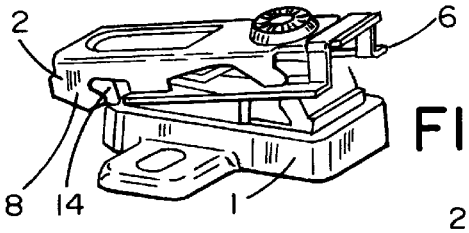
Figure 12A:
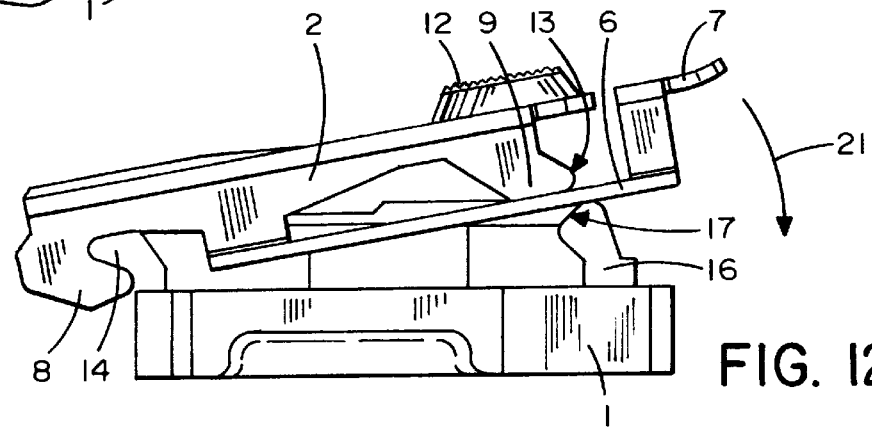
Figure 12B:
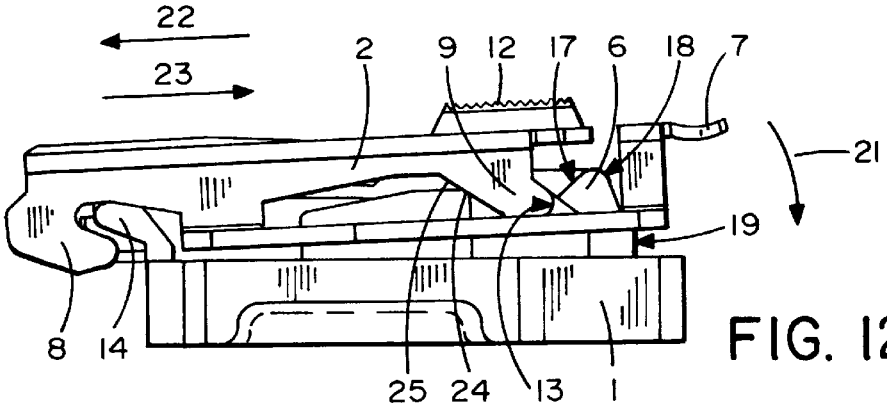
Figure 12C:
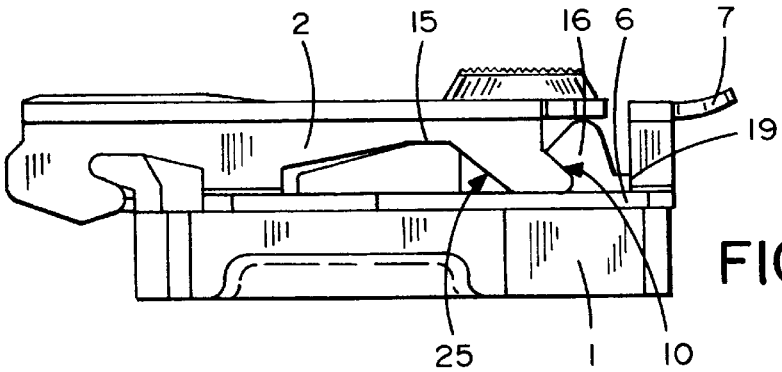
Figure 13:
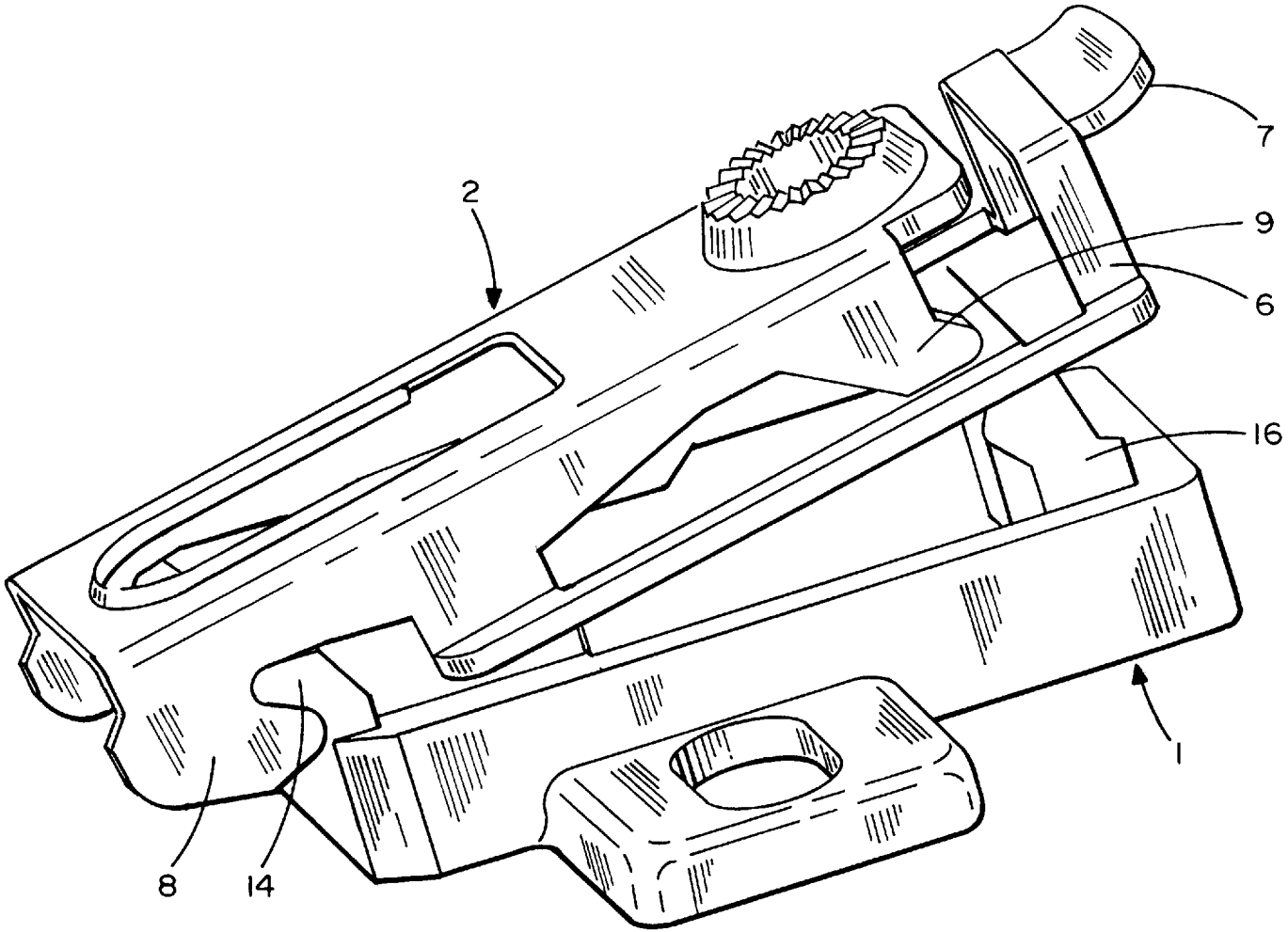

FIG. 1: shows a longitudinal section through the hinge;

FIG. 2: shows a perspective view of the hinge with a hinge arm released from the baseplate;

FIG. 3; shows the vertical section of the adjusting plate;

FIG. 4: shows the top view of the adjusting plate;

FIG. 5: shows the side view of the adjusting plate;

FIG. 6: shows the perspective embodiment of the adjusting plate;

FIG. 7: shows the vertical section of the baseplate;

FIG. 8: shows the top view of the baseplate;

FIG. 9: shows a side view of the baseplate;

FIG. 10: shows the perspective embodiment of the baseplate;

FIG. 11: shows the perspective embodiment of the adjusting plate and the baseplate in a non-engaged position;

FIG. 12*a*: shows the baseplate and adjusting plate in a non-engaged position;

FIG. 12*b*: shows the baseplate and adjusting plate during the engagement process:

FIG. 12*c*: shows the baseplate and adjusting plate in the engaged position; FIG. 13: shows a perspective view of the baseplate and adjusting plate in a non-engaged position, FIG. 14: shows a perspective view of the baseplate and adjusting plate in an engaged position.

In the following the directions utilized are front, back, up and down. The up and down indicators correspond to the direction up and down on the plane of projection.

As is evident in FIG. 1 and 2, the cabinet hinge consists basically of a hinge cup (5) that is inserted in the cabinet body. The hinge cup (5) is connected with a hinge arm (3) by a linkage (4). The hinge arm is fastened to an adjusting plate (2), which allows the position of the hinge arm (3) to be adjusted. In order to fasten the baseplate (1) to a cabinet/furniture door, the adjusting plate (2) can, relative to the invention, be snapped on so that the cabinet/furniture door can be connected by the hinge to the cabinet/furniture body.

FIG. 2 shows a perspective embodiment of the hinge whereby, the adjusting plate with the hinge arm (3) is released from the baseplate (1).

FIGS. 3 and 6 represent a possible embodiment of the adjusting plate (2). The adjusting plate (2) consists of a basically U-shaped bent, long, one piece component made preferably out of metal. A spring clip (6) is made in one piece with the adjusting plate and has shanks in approximately the center area of the lengthwise side, which are activated and continue towards the back over the end of the adjusting plate. There they connect to form a handle (7), which is the back end of the spring clip (6) so that the spring clip (6) can be operated by hand.

In the back area of the adjusting plate (2), close to the handle (7), shanks (9) are formed, which point somewhat towards the back. The upper slanted side of the shank (9) forms a bearing surface (10) that ends with a rounded edge (3). On the underside of the shank (9) is a slanted gliding surface (25) that runs somewhat parallel to the bearing surface (10).

On the opposite end more U-shaped shanks (8) are formed from the side walls of the adjusting plate. The shanks can link the adjusting plate (2) to the baseplate (1) and will be described more closely below.

The adjusting plate also has an elongated slot (11) and a bore hole formed in the bearing surface (12) for the adjustable fastening of the hinge arm (3).

FIGS. 7 to 10 show a possible embodiment of the baseplate (1). The baseplate (1) is fastened directly or by means of fastening flanges (20) to a cabinet/furniture door. It (the baseplate) is somewhat rectangular in shape and has projections (14) on the front end, which can be engaged by the hook-shaped shanks (8) of the adjusting plate (2). On the opposite end there are catch nose projections (16) that point somewhat slanted, upwardly and towards the front. Below, in the engaged position, these catch nose projections engage the shanks (9) of the adjusting plate (2). The catch nose projections (16) have two upper slanted gliding surfaces (17, 18) and a somewhat vertical lower bearing surface (19). There is another horizontal bearing surface (15) somewhat in the center area of the baseplate (1), whose bearing surface (15) ends on one side with a rounded edge (24).

FIG. 11 shows the first step's perspective embodiment of the connection of the adjusting plate (2) with the baseplate (1). The hook-shaped shanks (8) of the adjusting plate (2) link to the projections (14) of the baseplate by sliding the adjusting plate (2) on the baseplate.

FIGS. 12*a* through 12*c* show the rest of the catching engagement process in more detail.

The adjusting plate is already linked by its shanks (8) to the baseplate (1). Now by manually pressing from above on the bearing surface (12) of the adjusting plate (not, however, on the spring clip's handle) in the direction (21) downward (FIG. 12*a*). Then the rounded edge (13) of the adjusting plate's shanks (9) glides front/down on the slanted surfaces (17) of the catch nose projection (16) on the baseplate's side, and the adjusting plate (2) moves a little forward in the direction (22) because of the slanted gliding motion (FIG. 12*b*). The spring clip (6) is on the upper area of the catch nose projections' (16) surfaces (18) and stays there because of the spring's characteristics during the down/forward movement of the adjusting plate's (2) remaining components. When the edge (13) reaches the lower end of the gliding surface (17), the gliding motion of the adjusting plate (2) reverses. The spring clip (6) then forces a certain counter pressure or resistance on the adjusting plate until it overcomes the lower edge of the first gliding surface (17) and reverses its direction of motion.

As a result it follows that only the adjusting plate's (2) slanted lower gliding surface (25) ends up resting on the rounded edge (24) of the baseplate (1) and glides along this so that the adjusting plate (2) has an opposing horizontal movement towards the back in direction (23). Then the adjusting plate's (2) shank (9) slips under the catch nose projection (16) of the baseplate (1) and rests with its bearing surface (10) on the corresponding lower surfaces of the catch nose projection (16) (FIG. 12*c*). At the same time the spring clip glides downward along the slanted sliding surface (18) of the catch nose projection (16) and rests finally on the vertical bearing surface (19) of the catch nose projection (16).

Now the adjusting plate and the baseplate are engaged with each other.

Figure 14:
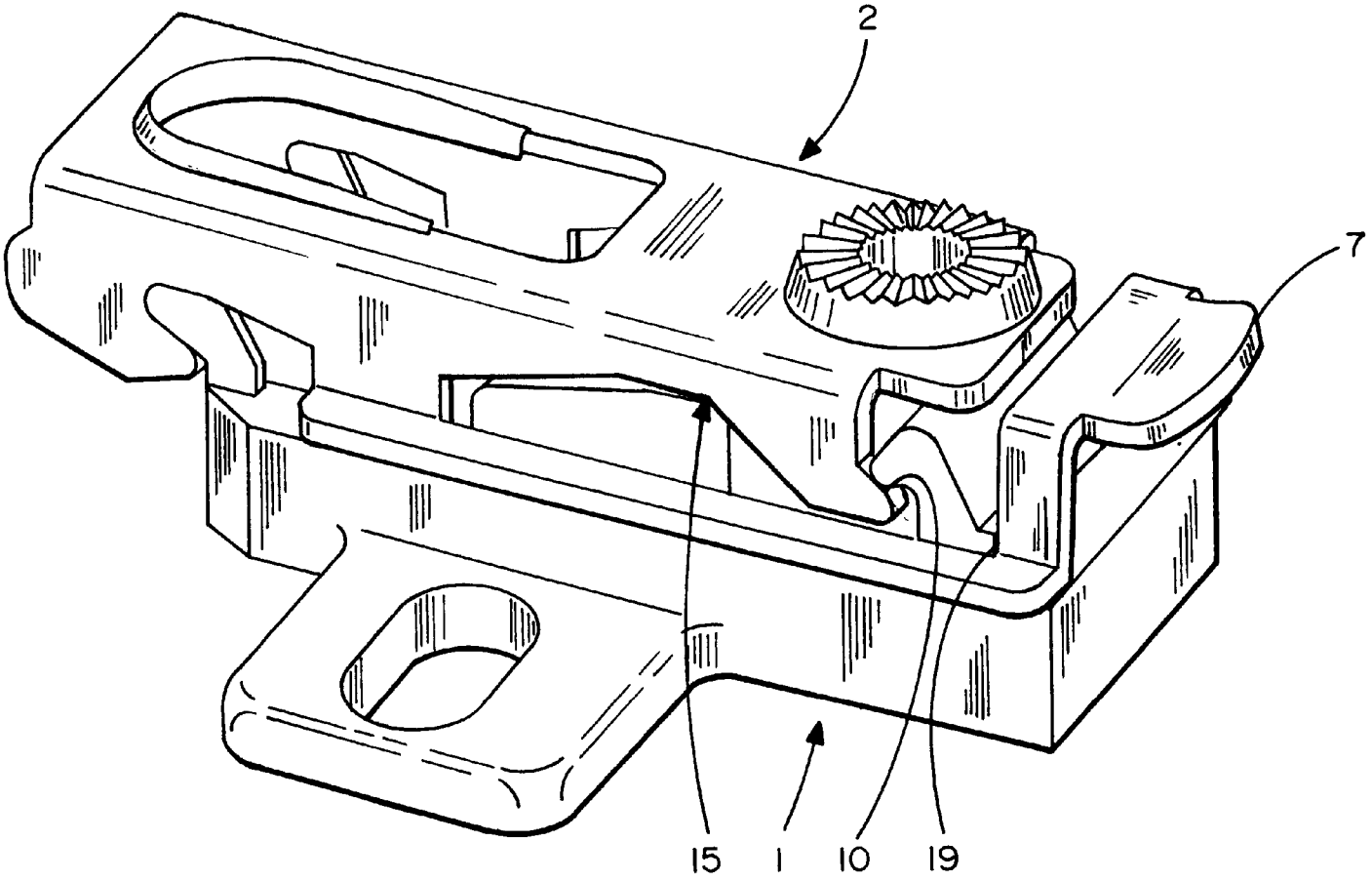

FIGS. 13 and 14 are perspective embodiments of the adjusting plate and the baseplate in a non-engaged and in an engaged position. One can see clearly how they work together and the positions for the "catching" or engaging processes' relevant components.

It is important that the spring clip (6) only secures against a horizontal shifting forward, but apart from that, must not be involved in lifting forces.

We claim:

1. Cabinet hinge comprising a hinge arm, an adjusting plate, and a fastening baseplate, the hinge arm having one end fastened on a hinge cup, and another end connected to one side of the adjusting plate, the adjusting plate also having an opposite side which engages the fastening baseplate through a snap-on connection secured by a resilient component member of the adjusting plate, wherein the hinge arm can be slidably adjusted by means of the adjusting plate, and wherein the adjusting plate engages the fastening baseplate by means of a plurality of hook-shaped shanks formed on the adjusting plate and disposed toward the side of the adjusting plate which engages the fastening baseplate, and wherein a force applied to the side of the adjusting plate which is connected to the hinge arm produces a forced sliding motion of the adjusting plate relative to the fastening baseplate such that at least one of the hook-shaped shanks engages a corresponding at least one catch nose projection of the fastening baseplate so that the resilient component on the adjusting plate stably secures the connection between the adjusting plate and the fastening baseplate against further sliding motion of the adjusting plate relative to the fastening baseplate.

2. Cabinet hinge, according to claim 1, wherein the hook-shaped shanks point towards the fastening baseplate and are formed from the lengthwise sides of the adjusting plate which depend at substantially right angles from the adjusting plate, wherein the hook-shaped shanks can be engaged in corresponding projections of the fastening baseplate.

3. Cabinet hinge, according to claim 1, wherein the at least one hook-shaped shank comprises an upper slanted bearing surface which ends with a rounded edge.

4. Cabinet hinge, according to claim 3, wherein opposing sides of the at least one hook-shaped shank comprise the upper slanted bearing surface and a slanted gliding surface, wherein the upper slanted bearing surface and a slanted gliding surface are substantially parallel to each other.

5. Cabinet hinge, according to claim 4, wherein the fastening baseplate has an upper bearing surface parallel to the lengthwise dimension of the adjusting plate which contacts the adjusting plate, and wherein the upper bearing surface ends on one side with a rounded edge which slidably contacts the slanted gliding surface of the at least one hook-shaped shank.

6. Cabinet hinge, according to claim 1, wherein the at least one catch nose projection of the fastening baseplate has an upper slanted gliding surface which joins an opposite running lower bearing surface at an angle thereby forming a rounded edge.

7. Cabinet hinge, according to claim 6, wherein the upper slanted gliding surface of the at least one catch nose projection of the fastening baseplate first moves the adjusting plate in the direction of a hinge attachment to a cabinet body during the engaging snap-on process, and then the slanted gliding surface of the at least one hook-shaped shank subsequently moves the adjusting plate the opposite direction towards the fastening baseplate until the slanted surface of the at least one hook-shaped shank of the adjusting plate rests on a corresponding slanted surface of the fastening baseplate so that the resilient component slides along a gliding surface over the catch nose projection and activates snap-on catch engagement between the resilient component and a lower bearing surface of the catch nose projection which is perpendicular to the lengthwise dimension of the fastening baseplate.

8. Cabinet hinge, according to claim 7, wherein disengagement of the adjusting plate and the fastening baseplate is accomplished by lifting the resilient component with a finger.

9. Cabinet hinge, according to claim 1, wherein said resilient component is formed in one piece from the adjusting plate so that it projects towards the fastening baseplate as a resilient frame-type border of the adjusting plate.

10. Cabinet hinge, according to claim 1 wherein the adjusting plate has a cross section formed somewhat U-shaped and glides lengthwise along the fastening baseplate during engagement or disengagement of the adjusting plate and the fastening baseplate.

* * * * *